US008479519B2

(12) United States Patent
Chen et al.

(10) Patent No.: US 8,479,519 B2
(45) Date of Patent: Jul. 9, 2013

(54) METHOD AND APPARATUS TO FACILITATE COOLING OF A DIFFUSION TIP WITHIN A GAS TURBINE ENGINE

(75) Inventors: Wei Chen, Greer, SC (US); William Lawrence Byrne, Simpsonville, SC (US); Xiaoguang Yu, Greer, SC (US); James Harper, Greenville, SC (US)

(73) Assignee: General Electric Company, Schenectady, NY (US)

( * ) Notice: Subject to any disclaimer, the term of this patent is extended or adjusted under 35 U.S.C. 154(b) by 919 days.

(21) Appl. No.: 12/350,083

(22) Filed: Jan. 7, 2009

(65) Prior Publication Data

US 2010/0170249 A1 Jul. 8, 2010

(51) Int. Cl.
*F02C 1/00* (2006.01)
*F02G 3/00* (2006.01)

(52) U.S. Cl.
USPC ..... 60/740; 60/742; 60/743

(58) Field of Classification Search
USPC ..... 60/740, 742, 743
See application file for complete search history.

(56) References Cited

U.S. PATENT DOCUMENTS

| | | | | |
|---|---|---|---|---|
| 2,942,790 | A * | 6/1960 | Starkey et al. | 239/405 |
| 5,146,741 | A * | 9/1992 | Sood | 60/39.55 |
| 5,288,021 | A * | 2/1994 | Sood et al. | 239/132.5 |
| 5,297,390 | A * | 3/1994 | Sood | 60/740 |
| 5,351,489 | A * | 10/1994 | Okamoto et al. | 60/740 |
| 5,579,645 | A * | 12/1996 | Prociw et al. | 60/740 |
| 5,685,139 | A * | 11/1997 | Mick et al. | 60/776 |
| 6,446,439 | B1 * | 9/2002 | Kraft et al. | 60/739 |
| 6,453,673 | B1 | 9/2002 | Bechtel et al. | |
| 6,460,340 | B1 | 10/2002 | Chauvette et al. | |
| 6,520,145 | B2 * | 2/2003 | Hunkert | 123/305 |
| 6,698,207 | B1 | 3/2004 | Wiebe et al. | |
| 7,024,861 | B2 | 4/2006 | Martling | |
| 7,174,717 | B2 * | 2/2007 | Prociw | 60/740 |
| 7,251,940 | B2 * | 8/2007 | Graves et al. | 60/742 |
| 7,444,980 | B2 * | 11/2008 | Cavanagh et al. | 123/299 |
| 7,506,512 | B2 * | 3/2009 | Schumacher et al. | 60/754 |
| 7,703,707 | B2 * | 4/2010 | Yasukawa et al. | 239/533.11 |
| 8,146,365 | B2 * | 4/2012 | Shum et al. | 60/740 |
| 2003/0213461 | A1 * | 11/2003 | Regueiro | 123/262 |
| 2004/0006988 | A1 * | 1/2004 | Stuttaford et al. | 60/776 |
| 2004/0050070 | A1 * | 3/2004 | Sprouse et al. | 60/776 |
| 2006/0191268 | A1 | 8/2006 | Widener et al. | |
| 2007/0044477 | A1 | 3/2007 | Held et al. | |
| 2007/0119177 | A1 | 5/2007 | McMasters et al. | |
| 2007/0214790 | A1 | 9/2007 | Bland | |
| 2009/0084109 | A1 * | 4/2009 | Lee et al. | 60/740 |

* cited by examiner

*Primary Examiner* — Phutthiwat Wongwian
*Assistant Examiner* — Michael B Mantyla
(74) *Attorney, Agent, or Firm* — Armstrong Teasdale LLP

(57) ABSTRACT

A method and apparatus for a diffusion tip for use with a fuel nozzle is described. The diffusion tip has a substantially circular body including an outer surface and an opposite inner surface. The diffusion tip body extends from a discharge end to an inlet end. The diffusion tip includes an inlet surface adjacent to the discharge end and defined within the body. A discharge surface is defined opposite the inlet surface. A plurality of diffusion apertures each extend between the discharge surface and the inlet surface, each aperture is oriented relative to the body to discharge a diffusion flow outward therefrom at an angle γ (gamma) measured in an X-Z plane between a centerline of the aperture and an X-axis extending tangentially to the outer surface, and at an angle θ (theta) measured in a Y-Z plane between the centerline of the aperture and a Y-axis extending radially outward from the centerline.

17 Claims, 8 Drawing Sheets

METHOD AND APPARATUS TO FACILITATE COOLING OF A DIFFUSION TIP WITHIN A GAS TURBINE ENGINE

BACKGROUND OF THE INVENTION

This invention relates generally to a gas turbine engine, and, more specifically, to diffusion tips of fuel nozzles used within gas turbine engines.

At least some known gas turbine engines ignite a fuel-air mixture in a combustor to generate a combustion gas stream that is channeled downstream to a turbine via a hot gas path. Compressed air is channeled to the combustor from a compressor. Known combustor assemblies use fuel nozzles that facilitate fuel and air delivery to a combustion zone defined in the combustor. The turbine converts thermal energy in the combustion gas stream to mechanical energy that rotates a turbine shaft. The output of the turbine may be used to power a machine, for example, an electric generator or a pump.

At least some known fuel nozzles include a diffusion tip. The diffusion tip forms a pathway for fuel, air or a combination of both, that works in combination with a main premixing circuit of the fuel nozzle. The integrated fuel and/or air mixture is discharged from the tip for ignition, prior to being channeled to a combustion zone.

During operation, fuel and/air is typically channeled through a plurality of passages formed within known diffusion tips and then combusted after exiting the diffusion tip. As a result, an exterior surface of the diffusion tip may be exposed to high temperature combustion gases. Continued exposure to the high temperatures may induce thermal stresses in the diffusion tip. Over time, such thermal stresses may cause cracking and/or mechanical failure of the diffusion tip. To facilitate reducing the temperature of the diffusion tip, at least some known diffusion tips include various cooling circuits. However, such cooling circuits may produce a fuel rich environment which may increase the formation of undesirable soot deposits on the diffusion tip. Soot deposits may adversely affect flow characteristics within the fuel nozzle and/or may increase the combustion temperature. The combination of altered flow characteristics and increased temperatures may adversely affect the operation of fuel nozzle components. For example, thermal degradation or annealing of the metallic alloys may result in reducing the structural integrity of the components.

Moreover, an increase in the operating temperature of a diffusion tip may also cause premature wear of the combustor hardware adjacent to the flame, such as, for example, a combustor liner, and/or transition piece assembly. As a result, such combustor hardware may require replacement more frequently than if the combustion temperatures were maintained at a lower temperature or greater reparability costs. To accommodate the operation with higher temperatures, at least some known combustors use components that are fabricated from special metal alloys that are more resistant to thermal wear. However, such components may add cost and/or weight to the engine as compared to engines having combustors that do not include thermally resistant components made from such alloys.

BRIEF DESCRIPTION OF THE INVENTION

In one aspect, a method for assembling a gas turbine engine is described. The method includes providing a fuel nozzle having a diffusion tip that includes a body having a substantially circular cross sectional area. The diffusion tip body includes an outer surface, an inner surface that is opposite the outer surface, and an inlet surface that is adjacent to an end of the body. The inlet surface is located radially inward from the body inner surface. The diffusion tip body further includes a discharge surface that is opposite the inlet surface. The method further includes coupling the fuel nozzle within the combustor assembly such that each of a plurality of diffusion apertures extending from the discharge surface to the inlet surface are oriented to discharge a diffusion flow from the fuel nozzle. The diffusion flow is discharged at an angle $\gamma$ (gamma) that extends into an X-Z plane and that is measured between a centerline of the aperture and an X-axis extending tangentially to the outer surface, and at an angle $\theta$ (theta) that extends into a Y-Z plane and that is measured between the centerline and a Y-axis that extends radially outward from the centerline.

In another aspect, a diffusion tip for use with a fuel nozzle is described. The diffusion tip has a substantially circular body including an outer surface and an opposite inner surface. The diffusion tip body extends from a discharge end to an inlet end. The diffusion tip includes an inlet surface adjacent to the discharge end and defined within the body. A discharge surface is defined opposite the inlet surface. A plurality of diffusion apertures each extend between the discharge surface and the inlet surface, each aperture is oriented relative to the body to discharge a diffusion flow outward therefrom at an angle $\gamma$ (gamma) measured in an X-Z plane between a centerline of the aperture and an X-axis extending tangentially to the outer surface, and at an angle $\theta$ (theta) measured in a Y-Z plane between the centerline of the aperture and a Y-axis extending radially outward from the centerline.

In still another aspect, a combustor assembly for use with a gas turbine engine is described. The combustor assembly includes a combustor and a fuel nozzle. The fuel nozzle is configured to discharge fuel into the combustor. The fuel nozzle includes a diffusion tip having a substantially circular body extending from an inlet end to a discharge end, an inlet surface adjacent to the discharge end and defined within the body. The body has a discharge surface opposite the inlet surface and a plurality of diffusion apertures that each extend from the discharge surface to the inlet surface. Each aperture is oriented relative to the body to discharge a diffusion flow therefrom at an angle $\gamma$ (gamma) measured in an X-Z plane between a centerline of the aperture and an X-axis extending tangentially to the outer surface, and at an angle $\theta$ (theta) measured in a Y-Z plane between the centerline and a Y-axis extending radially outward from the centerline.

DETAILED DESCRIPTION OF THE INVENTION

Figure 1:
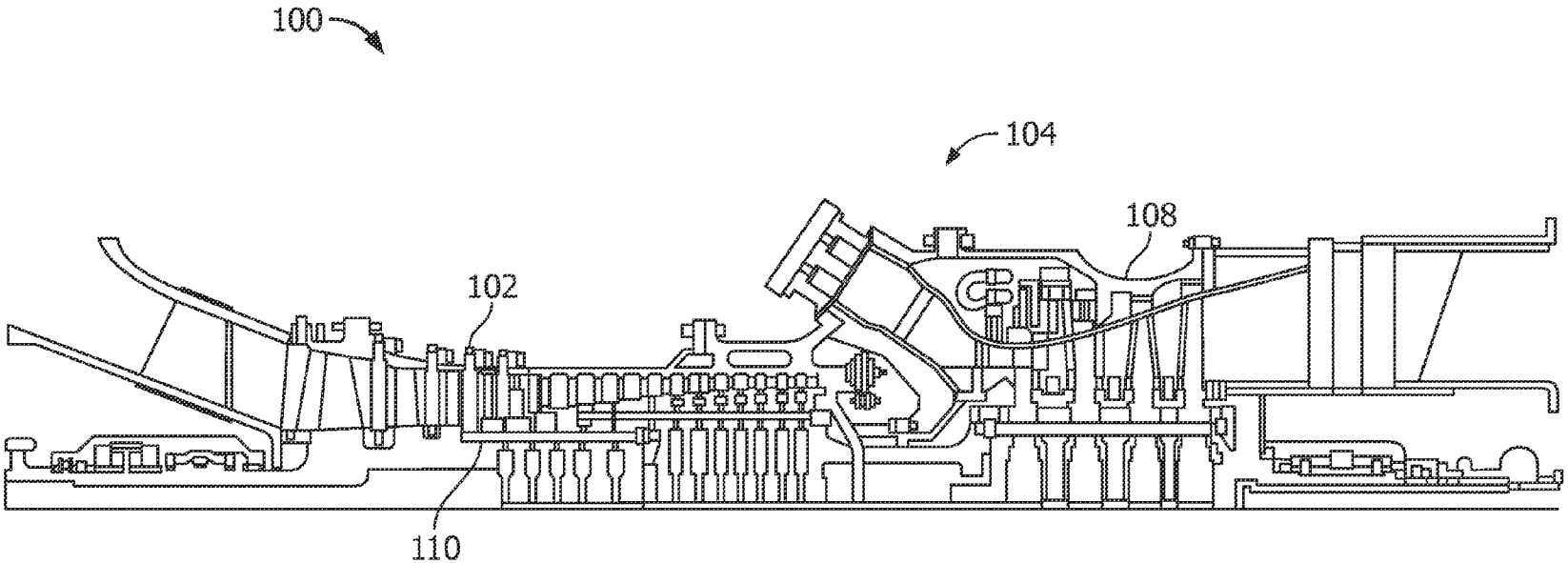
FIG. 1 is a schematic view of an exemplary gas turbine engine.

FIG. 1 is a schematic illustration of an exemplary gas turbine engine 100. Engine 100 includes a compressor assembly 102 and a combustor assembly 104. Engine 100 also includes a turbine 108 and a common compressor/turbine shaft 110 (sometimes referred to as a rotor 110). In operation, air flows through compressor assembly 102 such that compressed air is supplied to combustor assembly 104. Fuel is channeled to a combustion region and/or zone (not shown) that is defined within combustor assembly 104 wherein the fuel is mixed with the air and ignited. Combustion gases generated are channeled to turbine 108 wherein gas stream thermal energy is converted to mechanical rotational energy. Turbine 108 is rotatably coupled to shaft 110. It should also be appreciated that the term "fluid" as used herein includes any medium or material that flows, including, but not limited to, gas and air.

Figure 2:
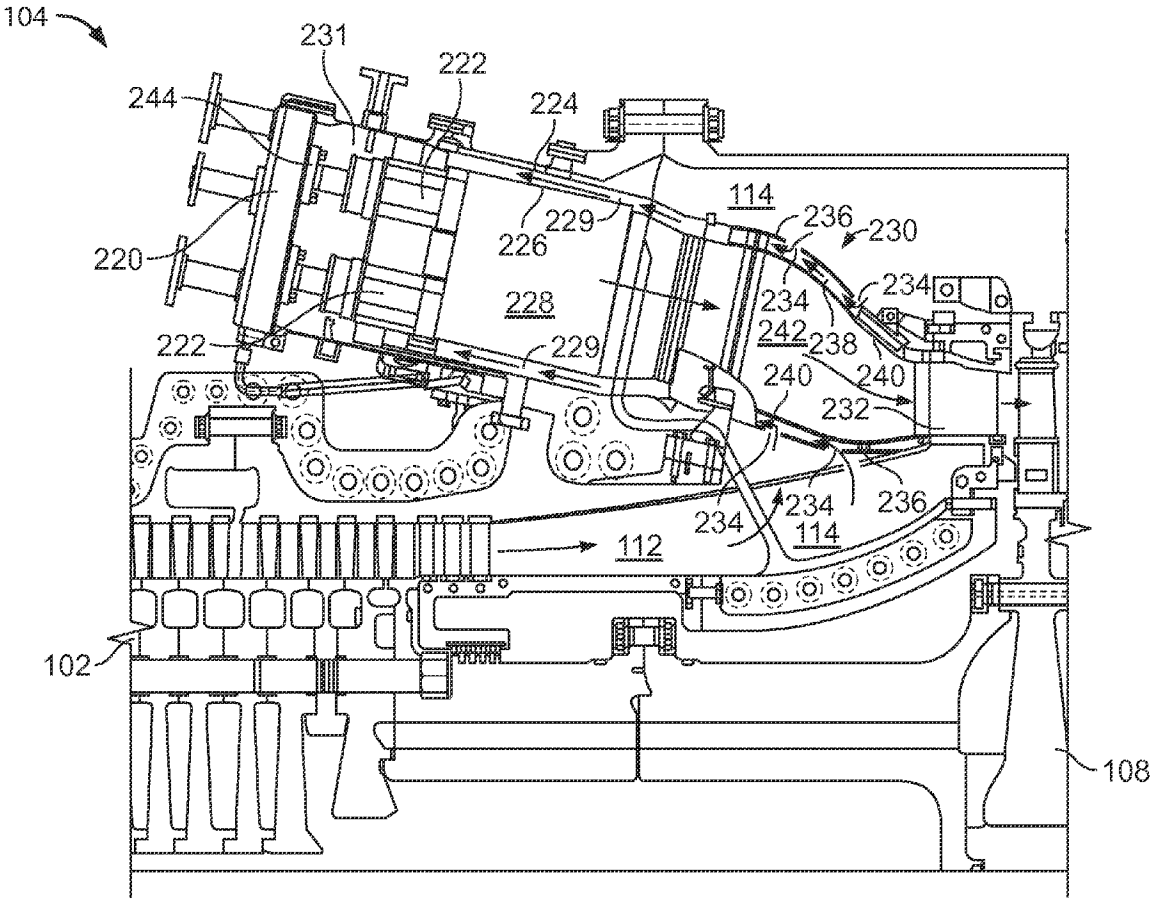
FIG. 2 is a cross-sectional schematic view of an exemplary combustor that may be used with the gas turbine engine shown in FIG. 1.

FIG. 2 is a cross-sectional schematic view of combustor assembly 104. Combustor assembly 104 is coupled in flow communication with turbine assembly 108 and with compressor assembly 102. In the exemplary embodiment, compressor assembly 102 includes a diffuser 112 and a compressor discharge plenum 114 that are coupled in flow communication to each other.

In the exemplary embodiment, combustor assembly 104 includes an end cover 220 that provides structural support to a plurality of fuel nozzles 222 that are oriented in an annular array about a turbine housing (not shown). End cover 220 is coupled to combustor casing 224 with retention hardware (not shown in FIG. 2). A combustor liner 226 is coupled within casing 224 such that liner 226 defines a combustion chamber 228. An annular combustion chamber cooling passage 229 is defined between combustor casing 224 and combustor liner 226.

A transition portion or piece 230 is coupled to combustor chamber 228 to channel combustion gases generated in chamber 228 downstream towards a turbine nozzle 232. In the exemplary embodiment, transition piece 230 includes a plurality of openings 234 formed in an outer wall 236. Transition piece 230 also includes an annular passage 238 that is defined between an inner wall 240 and outer wall 236. Inner wall 240 defines a guide cavity 242.

In operation, turbine assembly 108 drives compressor assembly 102 via shaft 110 (shown in FIG. 1). As compressor assembly 102 rotates, compressed air is discharged into diffuser 112 as the associated arrows illustrate. In one exemplary embodiment, the majority of air discharged from compressor assembly 102 is channeled through compressor discharge plenum 114 towards combustor assembly 104, and a smaller portion of compressed air is channeled for use in cooling engine 100 components. More specifically, the pressurized compressed air within plenum 114 is channeled into transition piece 230 via outer wall openings 234 and into passage 238. Air is then channeled from transition piece annular passage 238 into combustion chamber cooling passage 229. Air is discharged from passage 229 is channeled into fuel nozzles 222.

Fuel and air are mixed and ignited within combustion chamber 228. Casing 224 facilitates isolating combustion chamber 228 from the outside environment, for example, surrounding turbine components. Combustion gases generated are channeled from chamber 228 through transition piece guide cavity 242 towards turbine nozzle 232. In the exemplary embodiment, fuel nozzle assembly 222 is coupled to end cover 220 via a fuel nozzle flange 244.

Figure 3:
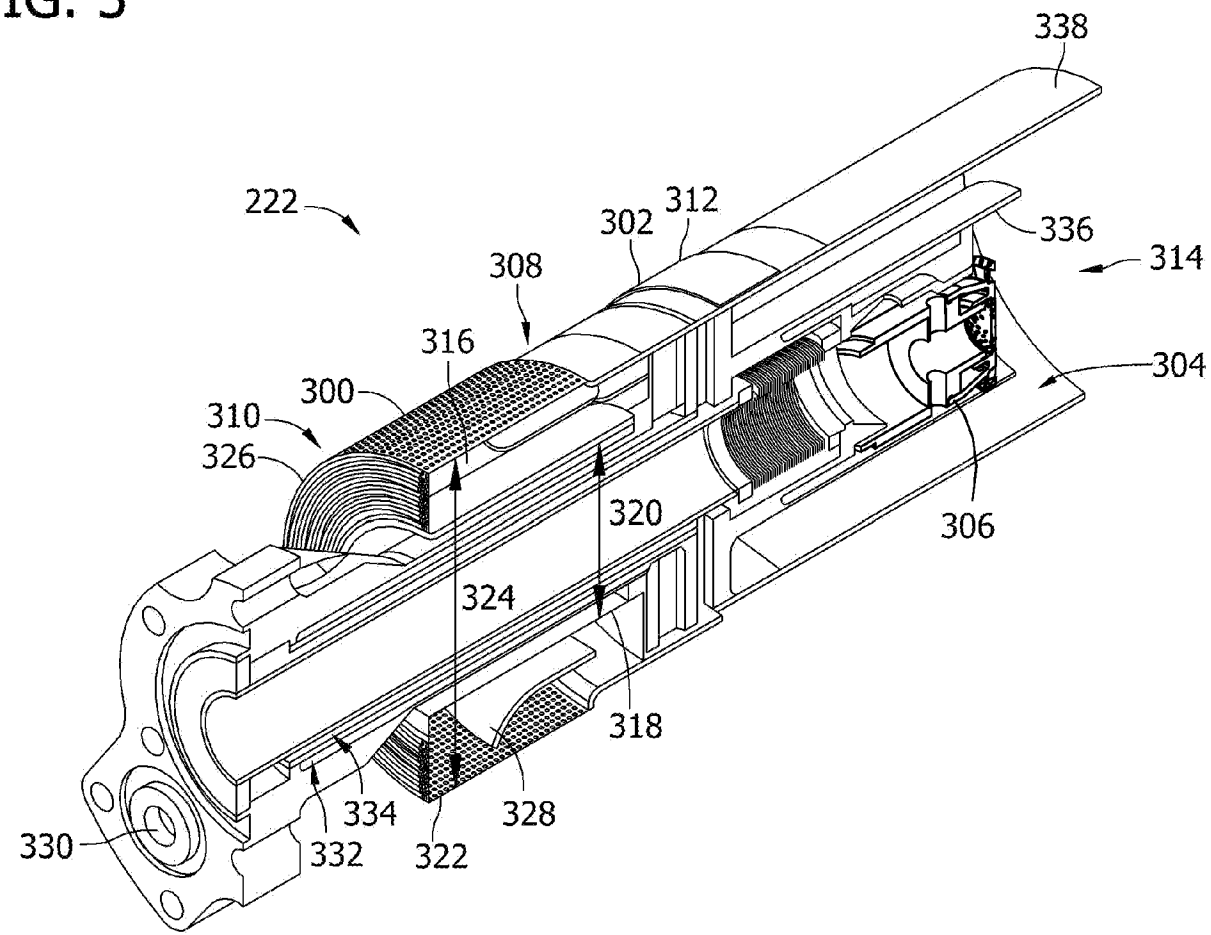
FIG. 3 is a perspective cross-sectional view of an exemplary fuel nozzle assembly that may be used with the combustor shown in FIG. 2.

FIG. 3 is a cross-sectional view of fuel nozzle assembly 222. Fuel nozzle assembly 222 includes an inlet flow conditioner (IFC) 300, a swirler assembly 302 with fuel injection, an annular, fuel-fluid mixing passage or premixing circuit 304, and a central diffusion flame fuel nozzle assembly or diffusion tip 306. Fuel nozzle assembly 222 also includes a high pressure plenum 308 that has an inlet end 310 and a discharge end 312. Plenum 308 circumscribes nozzle assembly 222. Discharge end 312 may not circumscribe nozzle assembly 222, but rather discharge end 312 may extend into a combustor reaction zone 314. IFC 300 includes an annular flow passage 316 that is defined by a cylindrical wall 318. Wall 318 defines an inside diameter 320 for passage 316, and a perforated cylindrical outer wall 322 defines an outside diameter 324. A perforated end cap 326 is coupled to an upstream end of fuel nozzle assembly 222. In the exemplary embodiment, flow passage 316 includes at least one annular guide vane 328 positioned thereon. Moreover, it should be understood that in the exemplary embodiment, nozzle assembly 222 defines a premix gas fuel circuit wherein fuel and compressed fluid are mixed prior to combustion.

Figure 4:
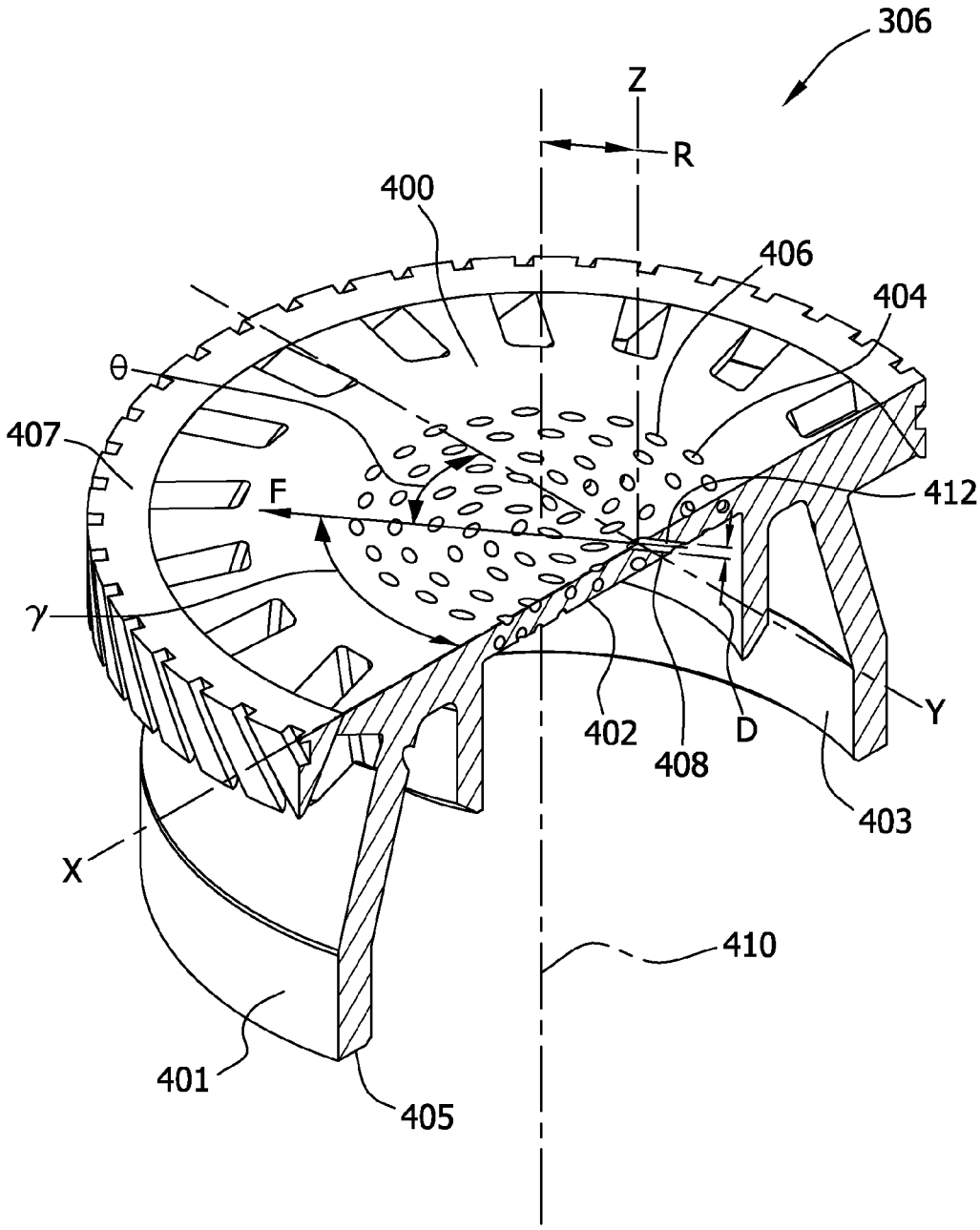
FIG. 4 is a perspective cross-sectional view of an exemplary diffusion tip assembly that may be used with the fuel nozzle shown in FIG. 3.
Figure 5:
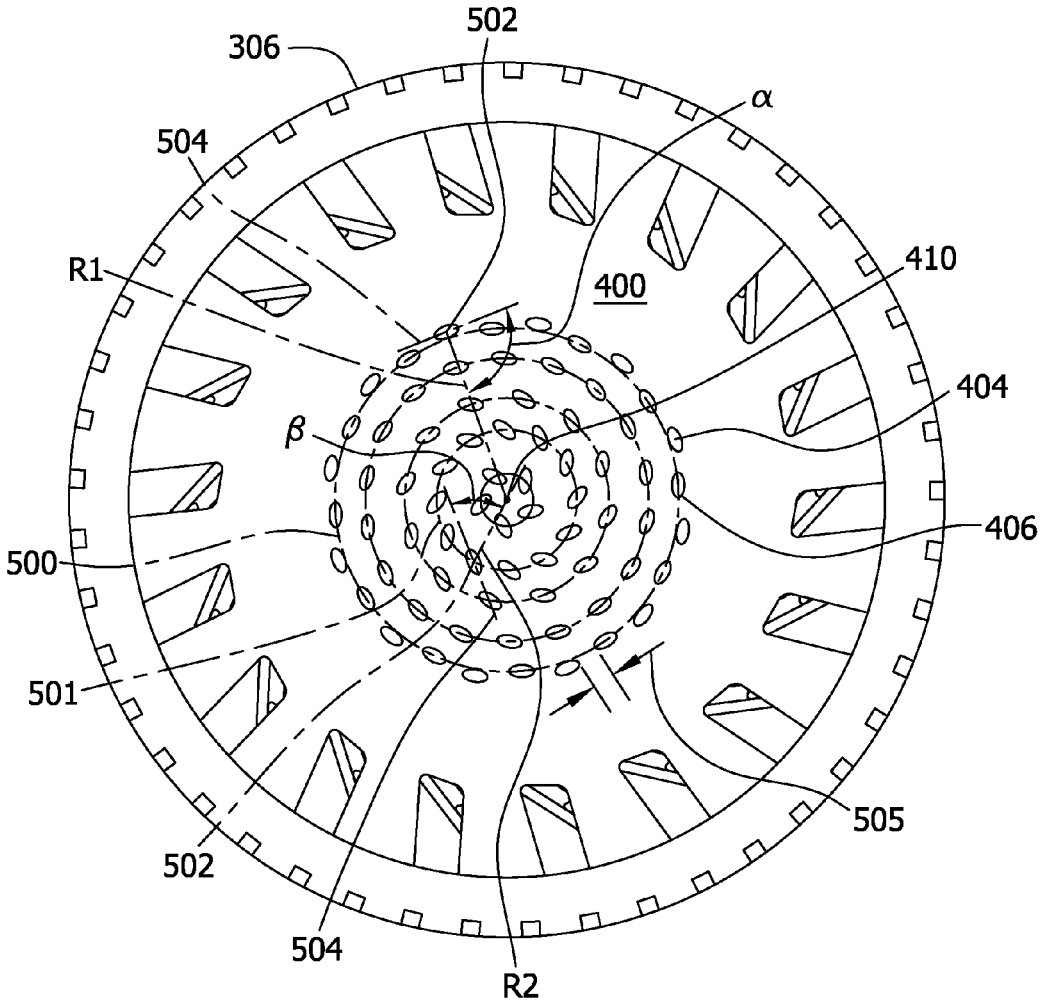
FIG. 5 is a plan view of an exemplary diffusion tip that may be used with the fuel nozzle shown in FIG. 3.
Figure 8:
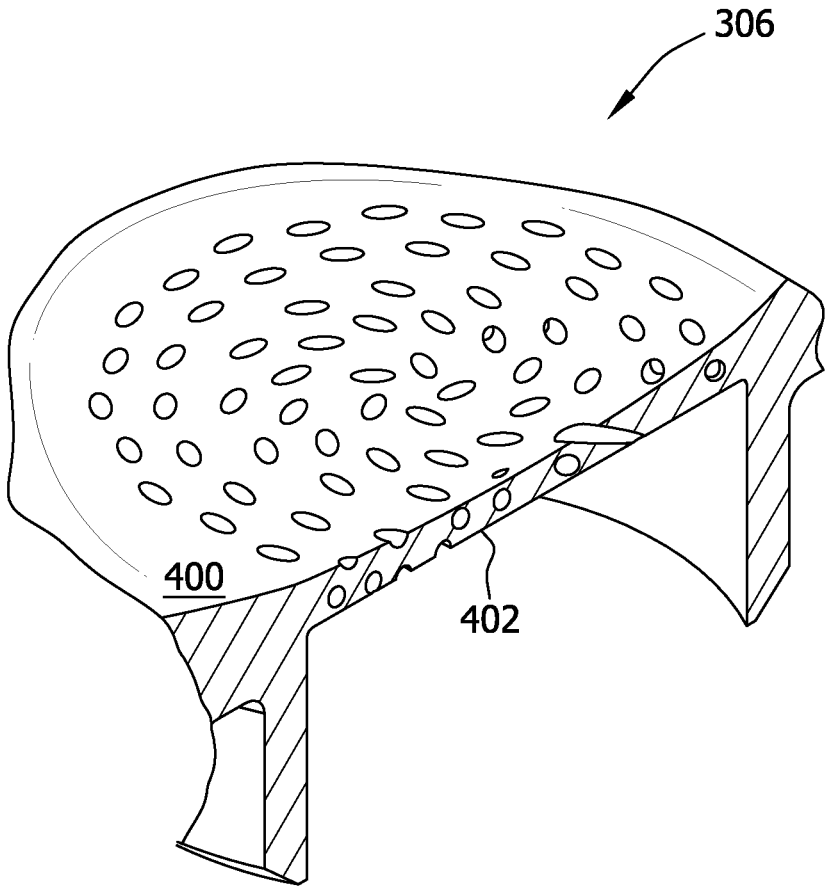
FIG. 8 is an enlarged cross-sectional view of an alternative embodiment of the diffusion tip shown in FIG. 4.

FIG. 4 is a perspective view of diffusion tip 306. FIG. 5 is a plan view of diffusion tip 306. In the exemplary embodiment, diffusion tip 306 includes an exterior surface 400 and an opposite interior surface 402. In the exemplary embodiment, exterior surface 400 is configured as a discharge surface and the interior surface 402 is configured as an inlet surface. The body of diffusion tip 306 is generally circular in cross-section and includes an outer surface 401, an opposing inner surface 403, an inlet end 405, and a discharge end 407. Diffusion tip 306 also includes a plurality of diffusion apertures 404 used to supply diffusion fuel and/or air to a combustion zone. In the exemplary embodiment, surface 400 is substantially planar. Alternatively, surface 400 may be concave, convex, or any shape that enables diffusion tip 306 to function as described herein, including the fluid flow and flame holding characteristics of diffusion tip 306 described herein. For example, in the alternative embodiment shown in FIG. 8, diffusion tip 306 has exterior surface 400 and interior surface 402, in which exterior surface 400 is configured as a discharge surface and is concave.

In the exemplary embodiment, each diffusion aperture 404 includes a forward opening 406 and an opposite aft opening 408, that are oriented such that each aperture 404 extends between openings 406 and 408. Forward opening 406 is defined along discharge surface 400 and aft opening 408 is defined along inlet surface 402. In the exemplary embodiment, forward openings 406 are each defined at a radius R measured from an axial centerline 410 of diffusion tip 306. Alternatively, openings 406 may be arranged in any orientation that enables operation of diffusion tip 306 as described herein. In the exemplary embodiment, diffusion tip 306 includes a plurality of rows of diffusion apertures 404. Each row of diffusion apertures 404 may include any number of apertures 404 that are circumferentially-spaced 505 in a circular array.

In the exemplary embodiment, forward openings 406 are each defined in radially inner wall 412 with a diameter D. The diameters of cooling holes or diffusion apertures 404 are determined by the formula:

$$D = d_0 + d_1 \times \left(\frac{R_0 - r}{R_0}\right)^{0.2} \times \left(\frac{1}{N}\right)^{0.4}$$

where N is the number of rows of cooling holes, $d_0$ and $d_1$ are experimental empirical coefficients, $R_0$ is the mean radius of the cooling hole, and r is the radius of the row. In one embodiment, diameter D may be between about 0.030 to about 0.060 inches. Each diffusion aperture 404 is oriented at various angles (described in greater detail below) and has a circular, elliptical, or any other cross-sectional shape that enables diffusion tip 306 to function as described herein.

A coordinate system is defined at each forward opening 406 such that an X-axis is aligned substantially tangentially relative to a circle having a radius R, a Y-axis is perpendicular to the X-axis in a radial direction, and a Z-axis is substantially aligned parallel to centerline 410. An angle γ (gamma) is measured from the X-axis in an X-Z plane, and an angle θ (theta) is measured from the Y-axis in a Y-Z plane. In the exemplary embodiment, each diffusion aperture 404 is oriented along a respective line F extending from each respective forward opening 406 at angle γ and at angle θ. As such, diffusion apertures 404 are arranged in a helical array about diffusion tip 306. Angle γ is determined by the formula:

$$\gamma = a + b \times \left(\frac{R_{e,swirler} - r}{R_{e,diffusion}}\right)^{0.74}$$

where a and b are experimental empirical coefficients, $R_{e,\ swirler}$ is the Reynold's number for the swirler assembly 302, and $R_{e,\ diffusion}$ is the Reynold's number for the diffusion tip 306 cooling. In one embodiment, angle γ is between about 15° to about 60°.

FIG. 5, illustrates a diffusion tip 306 and a plurality of circular diffusion aperture arrays 500. Each diffusion aperture array 500 is positioned at a radius measured with respect to centerline 410 to a center 502 of each respective aperture. For example, a first diffusion aperture array 500 is positioned at a radius R1 and a second diffusion aperture array 501 is positioned at a radius R2. A center 502 of each aperture is defined at a midpoint of a major axis 504 of a forward opening 406. In the exemplary embodiment, diffusion apertures 404, and corresponding arrays 500 and 501 includes at least one aperture 404 that is oriented towards centerline 410. Moreover, in the exemplary embodiment, the innermost arrays 501 include diffusion apertures 404 that are oriented inwardly at an angle β (beta) that is defined between radius R2 and aperture major axis 504. Angle β is determined by the formula:

$$\beta = c + d \times \left(\frac{T_{firing}}{T_{cooling}}\right)^{1.16}$$

where c is an experimental empirical coefficient and d is determined by the previously defined formula for diameter D, $T_{firing}$ is the flame temperature, and $T_{cooling}$ is the cooling air temperature. In the exemplary embodiment, angle β (beta) is between about 0° to about 90°. Alternatively, outermost arrays 500 may include diffusion apertures 404 that are oriented inwardly at an angle β (beta), and/or oriented outwardly at an angle α (alpha) defined between a radius R1 and axis 504. Angle α is determined by the same formula as angle β defined above. In one embodiment, angle α (alpha) is between about 90° to about 180°. In one embodiment, outermost circular arrays 500 include diffusion apertures 404 that are oriented in an alternating pattern, wherein the pattern includes at least some apertures oriented at angle α (alpha) and at least some oriented at angle β (beta).

In the exemplary embodiment, angles γ (gamma) and θ (theta) are variably selected to facilitate enhanced cooling of the discharge surface 400 of diffusion tip 306. More specifically, angle γ (gamma) is selected to ensure a small separation bubble is generated aft of diffusion aperture 404. The separation bubble facilitates the formation of a cooling air film layer across discharge surface 400. Angle θ (theta) is variably selected to facilitate distributing a substantially uniform cooling air film layer across diffusion surface 400. Moreover, in the exemplary embodiment, both angles γ (gamma) and θ (theta) are selected to produce a compound angle that facilitates maximizing diffusion tip cooling. Additionally, the radial R1 and/or R2 and circumferential 505 spacing of diffusion apertures 404 is selected to facilitate optimizing the thermal gradient and other combustion characteristics of diffusion tip 306. Aperture spacing may also be selected to facilitate reducing stress concentrations induced into the diffusion tip 306.

Figure 6:
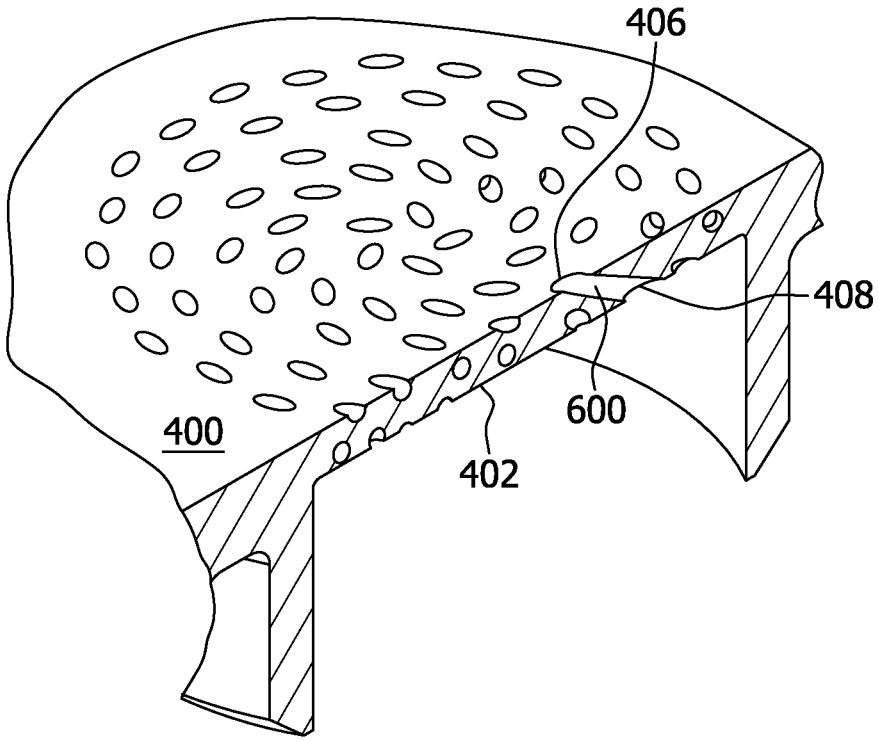
FIG. 6 is an enlarged cross-sectional view of the diffusion tip shown in FIG. 4.
Figure 7:
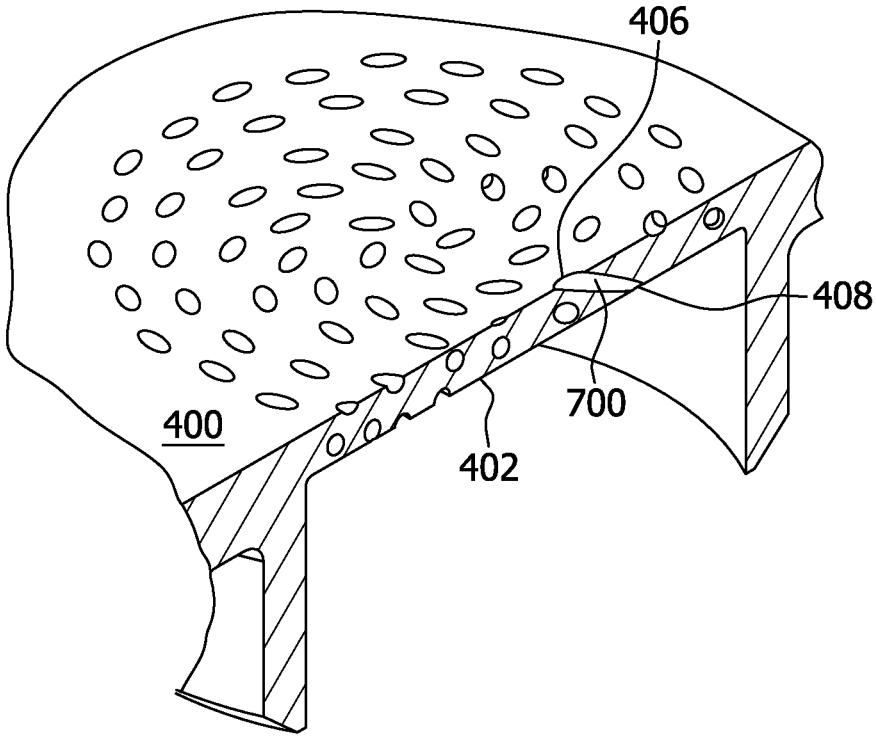
FIG. 7 is an enlarged cross-sectional view of an alternative embodiment of the diffusion tip shown in FIG. 4.

FIGS. 6 and 7 that illustrate alternative embodiments of diffusion tip 306. More specifically, in FIG. 6, diffusion tip 306 is configured as a convergent tip 600 and in FIG. 7 as a divergent tip 700. Convergent tip includes a plurality of apertures that are formed with an opening 408 that has a larger cross-sectional area than the opening 406. As shown in FIG. 6, opening 408 is larger than opening 406, which creates a convergent passage between opening 408 and opening 406. Conversely, in FIG. 7 opening 408 has a smaller cross-sectional area than opening 406 such that a divergent aperture 700 is defined between opening 408 and opening 406. Depending on the orientation of diffusion aperture 404, a thickness of diffusion tip 306 measured between surface 400 and surface 402, a pressure drop across the diffusion tip 306, and a required heat transfer coefficient of tip 306, either a convergent or divergent diffusion tip 600 or 700 may be used, with a fuel nozzle 222. In an alternate embodiment, a combination of both convergent and divergent apertures may be used to enhance diffusion tip cooling.

During operation, the discharge of flow through diffusion apertures 404 enhances the cooling of diffusion tip 306. A flow of diffusion flow through apertures 404 creates a diffusion circuit stream that mixes with and co-swirls with the premix circuit stream and in doing so, stabilizes a combustion recirculation zone formed adjacent to diffusion tip 306. By selecting various angular orientations for diffusion apertures 404, the tangential and axial velocities of the discharge flow are optimized to control mixing and/or co-swirling of the premix circuit and the diffusion flow discharged from diffusion apertures 404. Co-swirling of the diffusion circuit stream and the premix circuit stream facilitates preventing the combustion flame from contacting diffusion tip surface 400, thus reducing overheating and/or the formation of carbon black across the diffusion tip surface. The stratification of the premix circuit and diffusion flow facilitate increasing cooling film effectiveness and reducing diffusion tip thermal gradients and soot deposits. Orienting the diffusion apertures 404 at different orientations facilitates increasing an internal surface area of diffusion tip 306 such that diffusion tip cooling is enhanced, residence time for the cooling diffusion flow is increased and a heat transfer rate for the diffusion tip 306 is increased. Moreover, during operation, combustion thermoacoustics and flame oscillation are facilitated to be reduced because the co-swirling of the premix circuit and the diffusion flow strengthens overall swirling, increases mixing and/or combustion within the combustion chamber, and stabilize a swirling axis.

The invention described herein provides several advantages over known diffusion tip configurations. For example, one advantage of the diffusion tip described herein is that the angled diffusion apertures facilitate enhanced cooling flow across the discharge surface of the diffusion tip. Another advantage is that the diffusion apertures described herein facilitate preventing the contact of fuel and combustibles on the diffusion tip, as such soot build up and thermal stresses on the diffusion tip are reduced. Another advantage is that the diffusion apertures described herein facilitate increasing heat transfer and cooling of the diffusion tip. Moreover, the diffusion apertures described herein facilitate reducing thermal gradients induced into the diffusion tip and enables the diffusion tip to be fabricated with less expensive materials, resulting in reduced manufacturing costs.

Exemplary embodiments of a method and apparatus for uniform cooling of a diffusion tip for use with a gas turbine engine are described above in detail. The method and apparatus are not limited to the specific embodiments described herein, but rather, components of systems and/or steps of the methods may be utilized independently and separately from other components and/or steps described herein. For example, the method may also be used in combination with other fuel systems and methods, and are not limited to practice with only the fuel systems and methods as described herein. Rather, the exemplary embodiment can be implemented and utilized in connection with many other gas turbine engine applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention can be practiced with modification within the spirit and scope of the claims.

What is claimed is:

1. A method for assembling a gas turbine engine, said method comprising:

providing a fuel nozzle including a diffusion tip that includes a body having a substantially circular cross sectional area that extends along a centerline axis, wherein the body includes an outer surface, an inner surface that is opposite the outer surface, an inlet surface that is adjacent to an end of the body and that is radially inwardly from the body inner surface, and a discharge surface that is opposite the inlet surface;

defining a plurality of diffusion apertures within the diffusion tip such that each of the plurality of diffusion apertures extends from the discharge surface to the inlet surface are oriented to discharge a diffusion flow from the fuel nozzle, wherein the plurality of diffusion apertures include a first array of circumferentially-spaced diffusion apertures and a second array of circumferentially-spaced diffusion apertures that are spaced radially outwardly from the first array, and wherein the second array includes at least one diffusion aperture oriented obliquely with respect to a radial axis that extends radially outwardly from the diffusion tip centerline axis; and further defining the plurality of diffusion apertures within the diffusion tip such that at least a portion of the diffusion apertures are oriented inwardly at an angle β (beta) and such that at least another portion of the diffusion apertures are oriented outwardly at an angle α (alpha), wherein angles β and α are oblique angles defined between a centerline axis of a respective aperture and a radius extending perpendicular to a centerline axis of the diffusion tip; further defining the plurality of diffusion apertures to include at least one convergent tapered aperture and at least one divergent tapered aperture; and coupling the fuel nozzle within the combustor assembly.

2. A method in accordance with claim 1 wherein defining the plurality of diffusion apertures further comprises defining the plurality of diffusion apertures within the diffusion tip such that the plurality of diffusion apertures are spaced with at least one of a varied radial spacing and a circumferential spacing.

3. A method in accordance with claim 1 wherein the convergent and the divergent tapered apertures provide increased internal surface area and substantially facilitate increased heat transfer.

4. A method in accordance with claim 1 wherein providing the fuel nozzle further comprises providing a fuel nozzle including a diffusion tip that further comprises the discharge surface configured as a substantially concave surface.

5. A method in accordance with claim 1 wherein defining the plurality of diffusion apertures further comprises defining the plurality of diffusion apertures within the diffusion tip such that the first array is oriented within a first radial range and include at least one angled diffusion aperture at angle β (beta) with respect to a first radius and an aperture major axis located, and the second array is oriented within a second radial range and include at least one angled diffusion aperture at angle α (alpha) with respect to a second radius and an aperture major axis that is different than angle β.

6. A method in accordance with claim 5 wherein providing the diffusion tip further comprises defining the second array to include the plurality of diffusion apertures angled at alternating angles α (alpha) and β (beta).

7. A diffusion tip for use with a fuel nozzle, said diffusion tip comprising:

a substantially circular body comprising an outer surface and an opposite inner surface, said body extending from a discharge end to an inlet end along a centerline axis;

an inlet surface adjacent to said discharge end and defined within said body;

a discharge surface opposite said inlet surface; and a plurality of diffusion apertures extending between said discharge surface and said inlet surface, each said aperture is oriented relative to said body to discharge a diffusion flow outward therefrom, said plurality of diffusion apertures comprising a first array of circumferentially-spaced diffusion apertures and a second array of circumferentially-spaced diffusion apertures spaced radially outwardly from said first array, said second array comprising at least one diffusion aperture comprising a forward opening that is oriented obliquely with respect to a radial axis extending radially outwardly from the diffusion tip centerline axis;

wherein at least a first portion of said plurality of said diffusion apertures are apertures oriented inwardly at an angle β (beta) and wherein at least a second portion of said diffusion apertures are oriented outwardly at an angle α (alpha), wherein angles β and α are oblique angles defined between a centerline axis of a respective aperture and a radius extending perpendicular to a centerline axis of said diffusion tip; and wherein said plurality of diffusion apertures includes at least one convergent tapered aperture and at least one divergent tapered aperture.

8. A diffusion tip in accordance with claim 7 wherein each of said plurality of diffusion apertures are spaced with at least one of a varied radial spacing and a circumferential spacing.

9. A diffusion tip in accordance with claim 7 wherein each of said plurality of diffusion apertures comprise at least one of a convergent and a divergent tapered aperture, wherein said convergent and said divergent tapered apertures provide increased internal surface area and substantially facilitate increased heat transfer.

10. A diffusion tip in accordance with claim 7 wherein said discharge surface is substantially concave.

11. A diffusion tip in accordance with claim 7 wherein said first array is oriented within a first radial range and comprises at least one angled diffusion aperture at angle β (beta) with respect to a first radius and an aperture major axis; said second array is oriented within a second radial range and comprises at least one angled diffusion aperture at angle α (alpha) with respect to a second radius and an aperture major axis that is different than angle β.

12. A diffusion tip in accordance with claim 11 wherein said second array further comprise a plurality of diffusion apertures angled at alternating angles α (alpha) and β (beta).

13. A combustor assembly for use with a gas turbine engine, said combustor assembly comprising:

a combustor; and a fuel nozzle configured to discharge fuel into said combustor, said nozzle comprising a diffusion tip comprising:

a substantially circular body having an outer surface and an opposite inner surface, said body extending from an inlet end to a discharge end along a centerline axis:

an inlet surface adjacent to said discharge end and defined within said body;

a discharge surface opposite said inlet surface; and a plurality of diffusion apertures that each extend from said discharge surface to said inlet surface, each said aperture is oriented relative to said body to discharge a diffusion flow therefrom, said plurality of diffusion apertures comprising a first array of circumferentially-spaced diffusion apertures and a second array of circumferentially-spaced diffusion apertures spaced radially outwardly from said first array, said second array comprising at least one diffusion aperture comprising a forward opening that is oriented obliquely with respect to a radial axis extending radially outwardly from the diffusion tip centerline axis;

wherein at least a first portion of said plurality of said diffusion apertures are apertures oriented inwardly at an angle β (beta) and wherein at least a second portion of said diffusion apertures are oriented outwardly at an angle α (alpha), wherein angles β and α are oblique angles defined between a centerline axis of a respective aperture and a radius extending perpendicular to a centerline axis of said diffusion tip; and wherein said plurality of diffusion apertures includes at least one convergent tapered aperture and at least one divergent tapered aperture.

14. A combustor assembly in accordance with claim 13 wherein each of said plurality of diffusion apertures are spaced with at least one of a varied radial spacing and a circumferential.

15. A combustor assembly in accordance with claim 13 wherein said discharge surface is substantially concave.

16. A combustor assembly in accordance with claim 13 wherein each of said plurality of diffusion apertures comprise at least one of a convergent and a divergent tapered aperture, wherein said convergent and said divergent tapered apertures provide increased internal surface area and substantially facilitate increased heat transfer.

17. A combustor assembly in accordance with claim 13 wherein said first array is oriented within a first radial range and comprises at least one angled diffusion aperture at angle β (beta) with respect to a first radius and an aperture major axis said second array is oriented within a second radial range and include at least one angled diffusion aperture at angle α (alpha) with respect to a second radius and an aperture major axis that is different than angle β.

* * * * *